US009840914B2

(12) United States Patent
Malie et al.

(10) Patent No.: US 9,840,914 B2
(45) Date of Patent: Dec. 12, 2017

(54) METHOD FOR LOCALISED REPAIR OF A DAMAGED THERMAL BARRIER

(71) Applicants: SAFRAN AIRCRAFT ENGINES, Paris (FR); CENTRE NATIONAL DE LA RECHERCHE SCIENTIFIQUE, Paris (FR); INSTITUT NATIONAL POLYTECHNIQUE, Toulouse (FR); UNIVERSITE PAUL SABATIER—TOULOUSE III, Toulouse (FR)

(72) Inventors: André Hubert Louis Malie, Moissy-cramayel (FR); Sarah Hamadi, Moissy-cramayel (FR); Florence Ansart, Labege (FR); Jean-Pierre Bonino, Pechabou (FR); Hélène Cerda, Toulouse (FR); Guillaume Pujol, Toulouse (FR)

(73) Assignees: SAFRAN AIRCRAFT ENGINES, Paris (FR); CENTRE NATIONAL DE LA RECHERCHE SCIENTIFIQUE, Paris (FR); INSTITUT NATIONAL POLYTECHNIQUE, Toulouse (FR); UNIVERSITE PAUL SABATIER—TOULOUSE III, Toulouse (FR)

( * ) Notice: Subject to any disclaimer, the term of this patent is extended or adjusted under 35 U.S.C. 154(b) by 0 days.

(21) Appl. No.: 15/115,068

(22) PCT Filed: Dec. 11, 2014

(86) PCT No.: PCT/FR2014/053268

§ 371 (c)(1),
(2) Date: Jul. 28, 2016

(87) PCT Pub. No.: WO2015/114227

PCT Pub. Date: Aug. 6, 2015

(65) Prior Publication Data

US 2016/0348509 A1 Dec. 1, 2016

(30) Foreign Application Priority Data

Jan. 29, 2014 (FR) ..... 14 00224

(51) Int. Cl.
*F01D 5/00* (2006.01)
*C25D 13/02* (2006.01)
(Continued)

(52) U.S. Cl.
CPC ..... *F01D 5/005* (2013.01); *C25D 13/02* (2013.01); *C25D 13/12* (2013.01); *C25D 13/20* (2013.01);
(Continued)

(58) Field of Classification Search
CPC ..... F01D 5/005; F01D 5/288; F05D 2220/30; F05D 2230/30; F05D 2230/40;
(Continued)

(56) References Cited

U.S. PATENT DOCUMENTS

| | | | |
|---|---|---|---|
| 5,723,078 | A | 3/1998 | Nagaraj et al. |
| 2007/0119713 | A1 | 5/2007 | Hasz |

FOREIGN PATENT DOCUMENTS

| | | | |
|---|---|---|---|
| DE | 10335406 | * | 2/2005 |
| EP | 2 000 557 | A1 | 12/2008 |
| WO | WO 2008/029979 | A1 | 3/2008 |

OTHER PUBLICATIONS

International Search Report as issued in International Patent Application No. PCT/FR2014/053268, dated Apr. 24, 2015.

* cited by examiner

*Primary Examiner* — Kishor Mayekar
(74) *Attorney, Agent, or Firm* — Pillsbury Winthrop Shaw Pittman LLP

(57) ABSTRACT

A method of localized repair to a damaged thermal barrier, the method including subjecting a part coated in a damaged
(Continued)

thermal barrier to electrophoresis treatment, the part being made of an electrically conductive material, the damaged thermal barrier including a ceramic material and presenting at least one damaged zone that is to be repaired, the part being present in an electrolyte including a suspension of particles in a liquid medium, the ceramic coating being deposited by electrophoresis in the damaged zone in order to obtain a repaired thermal barrier for use at temperatures higher than or equal to 1000° C., the particles being made of a material different from the ceramic material present in the damaged thermal barrier.

20 Claims, 3 Drawing Sheets

(51) Int. Cl.

| | |
|---|---|
| ***C25D 13/22*** | (2006.01) |
| ***F01D 5/28*** | (2006.01) |
| ***C25D 13/12*** | (2006.01) |
| ***C25D 13/20*** | (2006.01) |

(52) U.S. Cl.
CPC ..... *C25D 13/22* (2013.01); *F01D 5/288* (2013.01); *F05D 2220/30* (2013.01); *F05D 2230/30* (2013.01); *F05D 2230/40* (2013.01); *F05D 2230/90* (2013.01); *F05D 2300/20* (2013.01); *F05D 2300/5023* (2013.01)

(58) Field of Classification Search
CPC ..... F05D 2300/20; F05D 2300/5023; C25D 13/02; C25D 13/12; C25D 13/20; C25D 13/22
See application file for complete search history.

METHOD FOR LOCALISED REPAIR OF A DAMAGED THERMAL BARRIER

CROSS-REFERENCE TO RELATED APPLICATIONS

This is the U.S. National Stage of PCT/FR2014/053268, filed Dec. 11, 2014, which in turn claims priority to French Patent Application No. 14/00224, filed Jan. 29, 2014, the entire contents of all applications are incorporated herein by reference in their entireties.

BACKGROUND OF THE INVENTION

The invention relates to methods of localized repair to damaged thermal barriers.

The blade sets of high-pressure turbines in aeroengines are exposed to an environment that is very aggressive. In general, such parts are coated by an oxidation protection coating and by a thermal barrier coating. The thermal barrier coating serves to insulate the underlying part thermally so as to enable it to be maintained at temperatures where its mechanical performance and its lifetime are acceptable.

Certain zones of the system may be damaged in service at high temperature by erosion, by particle impact, by oxidation, by corrosion, and by calcium and magnesium aluminosilicates (CMAS). The photographs provided in FIGS. 1 and 2 show the appearance of blades that have been damaged in service. Such degradation can lead to local disappearance of the thermal barrier layer and even of the underlayer, leading to oxidation of the underlying part.

At present, in order to reconstitute a thermal barrier, it is known to remove the entire thermal barrier coating (even the zones that are not damaged) of parts and then to make a new thermal barrier system. In certain circumstances, parts having a thermal barrier that has been damaged may even need to be discarded.

There exists a need to improve the length of time for which parts coated by thermal barriers can be used.

There exists a need to simplify and reduce the cost of methods of repairing damaged thermal barriers.

There also exists a need to have new methods of repairing damaged thermal barriers.

OBJECT AND SUMMARY OF THE INVENTION

To this end, the invention provides a method of localized repair to a damaged thermal barrier, the method comprising the following step:

a) subjecting a part coated by a damaged thermal barrier to electrophoresis treatment, the part being made of an electrically conductive material, the damaged thermal barrier comprising a ceramic material and presenting at least one damaged zone that is to be repaired, the part being present in an electrolyte comprising a suspension of particles in a liquid medium, the ceramic coating being deposited by electrophoresis in the damaged zone in order to obtain a repaired thermal barrier for use at temperatures higher than or equal to 1000° C.

In the invention the part is made of an electrically conductive material and the damaged thermal barrier enables electricity to be conducted in the damaged zone that is to be repaired, and thus enables the ceramic coating to be deposited by electrophoresis in this zone during step a). The ceramic coating obtained during step a) is formed by depositing particles on the part. The majority of the ceramic coating that is deposited may be deposited in the damaged zone. In other words, a ceramic coating mass greater than or equal to 50% of the total mass of ceramic coating deposited during step a) may be deposited in the damaged zone. By way of example, this mass of ceramic coating deposited in the damaged zone may be greater than or equal to 75%, or even 90%, of the total mass of the ceramic coating deposited during step a). In an implementation, the ceramic coating may be deposited solely in the damaged zone.

Advantageously, the invention makes it possible in rapid, inexpensive and localized manner to repair the damaged thermal barrier and thus avoid partially degraded parts being discarded or indeed avoid removing the entire damaged thermal barrier. Consequently, the invention makes it possible to lengthen the lifetime of parts and to limit the cost of putting back into operation parts having a thermal barrier that has been damaged.

The possibility of repair being localized results from using deposition by electrophoresis, as contrasted to the methods of deposition by plasma spraying (PS) or by electron beam physical vapor deposition (EB-PVD) that make it difficult or impossible to perform repair in localized manner.

Also, the method of deposition by electrophoresis presents the advantage of being usable on parts that present shapes that are complex.

The repaired thermal barrier may be for use in an environment where the temperature at the surface of the thermal barrier is higher than or equal to 1000° C.

The part may advantageously be made of a metal material, and it may include nickel, by way of example.

Advantageously, prior to performing step a), the damaged thermal barrier may present a lack of material in the damaged zone.

In an implementation, the possibly agglomerated particles may present a mean size that is less than or equal to 10 μm.

The term "mean size" is used to mean that the dimension given by the half population statistical grain size distribution, known as D50.

For example, the particles in the non-agglomerated state may have a mean size lying in the range 20 nm to 1 μm.

Such particle sizes serve advantageously to obtain a suspension that is stable.

The particles may optionally be obtained by using a sol-gel technique. Thus, in an implementation, prior to step a), the method may include a step of forming the particles by performing a sol-gel method. Thereafter, the particles may be dispersed in the liquid medium in order to form the electrolyte.

By way of example, the electrolyte particles may be particles of yttria-stabilized zirconia (YSZ), which may optionally be obtained by a sol-gel technique. It is also possible to use particles of zirconium oxide. More generally, for deposition by electrophoresis, it is possible to use any particles capable of presenting an electric charge within the electrolyte (thus enabling them to be moved when an electric field is applied). Thus, by way of example, it is possible to use particles having the following chemical formulae: $ZrO_2$—$ReO_{1.5}$ (where Re designates a rare earth element, e.g.: Gd, Sm, or Er), $Y_2O_3$, $Al_2O_3$, $TiO_2$, or $CeO_2$.

In an implementation, the particles may be made of the same ceramic material as that present in the damaged thermal barrier.

In a variant, the particles may be made of a material different from the ceramic material present in the damaged thermal barrier. Under such circumstances, the material constituting the particles and the ceramic material of the damaged thermal barrier are advantageously compatible both thermomechanically and chemically. For example, the difference between the coefficients of thermal expansion of the ceramic material present in the damaged thermal barrier and of the material constituting the particles may advantageously be less than or equal to $2.10^{-6}K^{-1}$ in absolute value.

The use of a different material may advantageously make it possible to introduce an additional property, e.g. an anti-CMAS property or temperature-sensitive material, thereby functionalizing the thermal barrier while also repairing it.

By way of example, the liquid medium may be selected from: alcohols, e.g. ethanol or isopropanol, ketones, e.g. acetyl acetone, water, and mixtures thereof.

In an implementation, before the beginning of step a), the particles may be present in the liquid medium at a concentration greater than or equal to 0.1 g/L, and preferably greater than or equal to 1 grams per liter (g/L).

Such concentration values advantageously make it possible to have a suspension that is stable.

In an implementation, the deposited ceramic coating may present thickness that is greater than or equal to 50 nanometers (nm), e.g. greater than or equal to 30 micrometers (μm). In an implementation, the thickness of the deposited ceramic coating may be less than or equal to 200 μm.

In an implementation, the part may be coated in an attachment layer enabling the thermal barrier to attach to the part, and the ceramic coating may be deposited on the attachment layer.

The attachment layer serves advantageously to improve the attachment of the thermal barrier to the part. In addition, the attachment layer may advantageously enable the part to be protected against oxidation and corrosion.

By way of example, the attachment layer may be made of metal.

In a variant, the thermal barrier may be present directly on the part. Thus, it is possible for there to be no attachment layer present between the thermal barrier and the part.

In an implementation, the duration of step a) may be greater than or equal to 1 minute, preferably greater than or equal to 5 minutes.

Such values serve advantageously to improve the covering ability and the uniformity of the ceramic coating that is formed.

In an implementation, a voltage greater than or equal to 1 volt (V) may be imposed during all or part of step a) between the part and a counter electrode. The voltage imposed during part or all of step a) is preferably greater than or equal to 50 V.

Such values serve advantageously to improve the covering nature and the uniformity of the ceramic coating that is formed.

In an implementation, prior to step a), the damaged zone may have been subjected to a stripping step.

Stripping serves advantageously to eliminate residues of the thermal barrier and of the oxide layers that might be present, and also to improve the electrically conductive nature of the damaged zone that is to be repaired so as to enhance deposition of the ceramic coating by electrophoresis.

Stripping may also be performed mechanically, e.g. by sandblasting, sanding, grinding, high-pressure water jet, or by laser cleaning.

In a variant, the stripping may be chemical stripping, e.g. electrolytic stripping or stripping in an acidic or basic medium.

After stripping, at the beginning of step a), the damaged thermal barrier may present a lack of material in the damaged zone.

In an implementation, after step a), the method may include a step b) of consolidation by subjecting the deposited ceramic coating to heat treatment.

By way of example, step b) may include subjecting the part obtained after performing step a) to a temperature higher than or equal to 1000° C., e.g. higher than or equal to 1100° C.

In an implementation, the part constitutes a turbine engine blade.

BRIEF DESCRIPTION OF THE DRAWINGS

Other characteristics and advantages of the invention appear from the following description given with reference to the accompanying drawings, in which.

DETAILED DESCRIPTION OF IMPLEMENTATIONS

Figure 1:
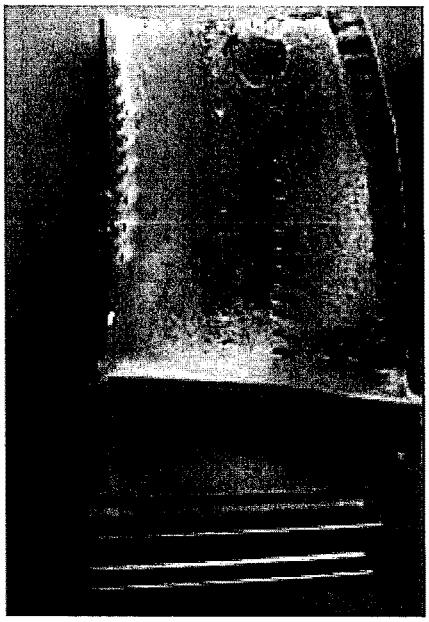
FIG. 1 is a photograph of a turbine engine blade damaged in service.
Figure 2:
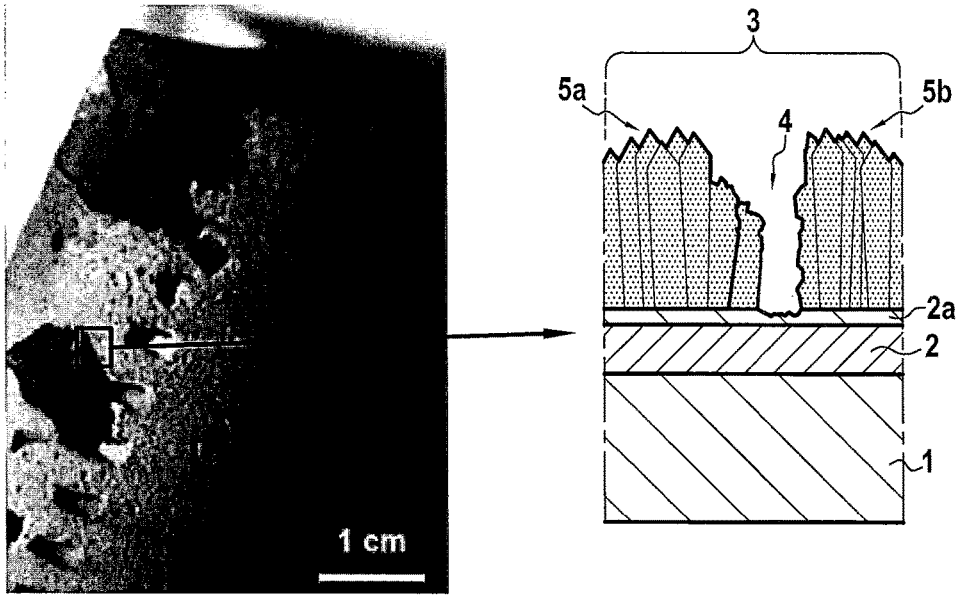
FIG. 2 comprises a photograph of a turbine engine blade damaged in service together with a fragmentary diagram illustrating the structure of the damaged thermal barrier.

FIG. 2 shows a part 1, e.g. made of a nickel-based superalloy, coated by an adhesion layer 2 having a damaged thermal barrier 3 present thereon. An oxide layer 2*a* is present between the adhesion layer 2 and the damaged thermal barrier 3. The layer 2*a* may be made of $\alpha$-$Al_2O_3$ alumina. The damaged thermal barrier 3 comprises a ceramic material and it presents a damaged zone 4 that is to be repaired.

The damaged zone 4 may present at least one adjacent zone that is not damaged. In the example shown, the damaged zone 4 is present between two adjacent zones 5*a* 5*b* that are not damaged.

Figure 3A:
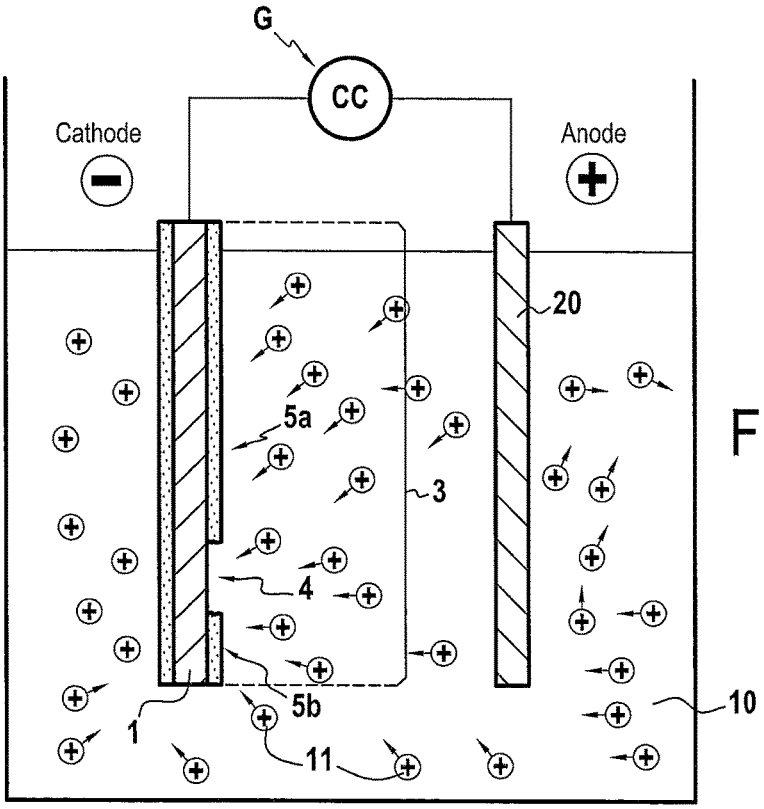
FIGS. 3A and 3B show, in diagrammatic and fragmentary manner, the performance of a method of the invention.
Figure 3B:
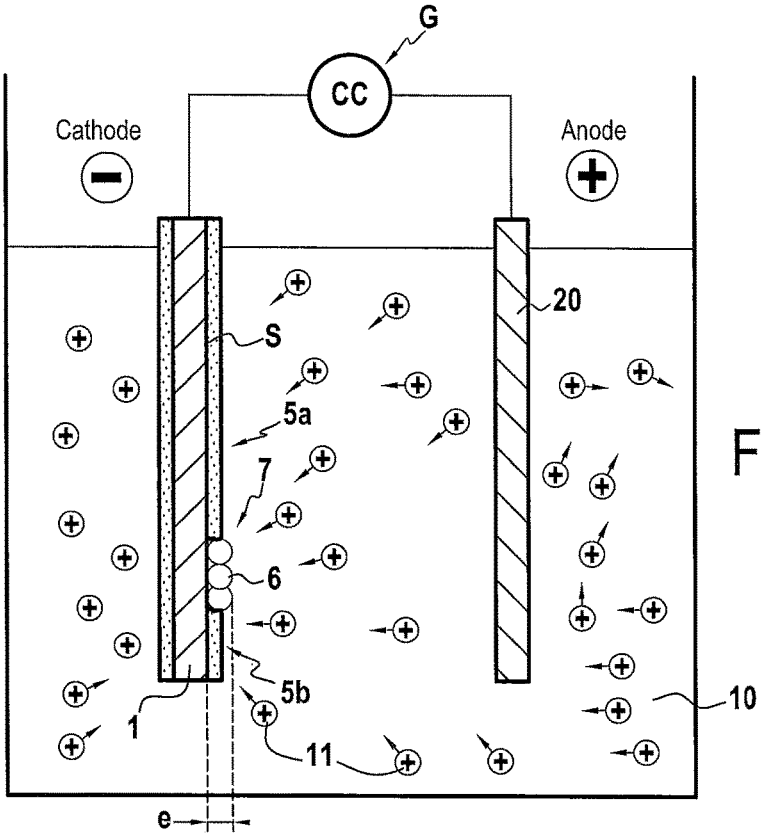

FIG. 3A shows the implementation of a step a) of the invention. As shown, the part 1 carrying the damaged thermal barrier 3 is present in an electrolyte 10 comprising a suspension of particles 11 in a liquid medium. By way of example, the particles 11 may be particles of yttria-stabilized zirconia (zirconia stabilized by yttrium oxide).

By way of example, there follows a description of the steps of sol-gel synthesis of an yttria-stabilized zirconia powder for use, in one implementation, in forming the particles 11:

- mixing acetyl acetone in 1-propanol and zirconium propoxide ($Zr(OC_3H_7)_4$);
- mixing the resulting mixture with a solution of yttrium nitrate in 1-propanol;
- mixing the resulting mixture with water and with 1-propanol (10 moles per liter (mol/L)) in order to obtain a sol;
- stoving the sol at a temperature of 50° C.;
- evaporative drying or supercritical drying; and
- calcination in air at a temperature of 700° C.

The oxide powder (yttria-stabilized zirconia) as obtained in this way is then put into suspension in a liquid medium, e.g. constituted by isopropanol in order to form the electrolyte 10.

The part 1 coated by the damaged thermal barrier 3 constitutes one electrode of the electrophoresis system, and it has a counter electrode 20 placed facing it. By way of example, the counter electrode 20 is made of platinum. Because of the conductive nature of the part 1 and of the damaged zone 4, deposition by electrophoresis takes place in the damaged zone 4. In the example shown, the damaged zone 4 is constituted by a region lacking material. In a variant that is not shown, the damaged zone comprises a first region that is lacking in material together with a second region in which a ceramic layer is present, the thickness of the ceramic layer present in the second region being small enough for the second region to be electrically conductive. In another variant, the damaged zone comprises a region in which a ceramic layer is present, the thickness of the ceramic layer being small enough for this region to be electrically conductive.

Deposition takes place preferentially in the most conductive zones (ceramic layer of sufficiently small thickness or total absence of ceramic layer) since the electric field is relatively high in such zones.

An implementation is shown in which the damaged thermal barrier 3 presents a single damaged zone 4 that is to be repaired, but it would not go beyond the ambit of the present invention for the damaged thermal barrier to present a plurality of damaged zones that are to be repaired. Under such circumstances, each of the damaged zones to be repaired is electrically conductive.

During step a), a generator G imposes a potential difference between the part 1 and the counter electrode 20. The generator G generates direct current (DC) or pulses. The part 1 is biased with a charge opposite to the charge of the particles 11. As a result of an electric field being applied between the part 1 and the counter electrode 20, the particles 11 move and become deposited on the part 1 in order to form a ceramic coating 6. Depositing the ceramic coating 6 in the damaged zone 4 enables a repaired thermal barrier 7 to be obtained. Depositing the ceramic coating 6 in the damaged zone 4 progressively reduces the electrical conductivity of this zone over time. Specifically, as the ceramic coating 6 continues to be deposited, this zone becomes more and more insulating, thereby slowing down or even stopping the formation of the ceramic coating 6 on the part 1.

As shown, the ceramic coating 6 is deposited in the damaged zone 4 and covers the entire surface of the damaged zone 4.

Advantageously, while the ceramic coating 6 is being deposited, the damaged thermal barrier 3 is not covered in a mask presenting an opening overlying the damaged zone 4 that is to be repaired. Also, there is no need before the step a) to remove a portion of the damaged thermal barrier 3 situated outside the damaged zone 4 that is to be repaired.

The ceramic coating 6 may present thickness e that is greater than or equal to 50 nm, e.g. greater than or equal to 30 μm. The thickness e of the ceramic coating 6 corresponds to its greatest dimension as measured perpendicularly to the surface S of the coated part 1.

After step a), it is possible to subject the ceramic coating 6 to drying followed by consolidation heat treatment.

EXAMPLE

Figure 4A:
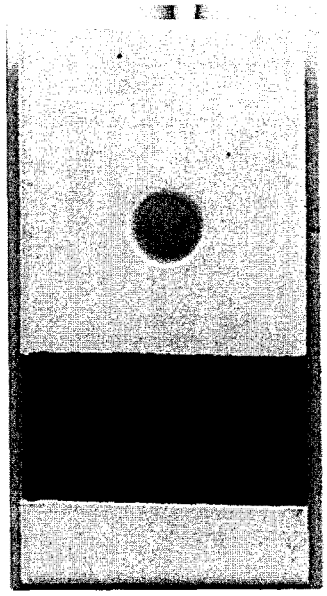
FIGS. 4A and 4B are photographs showing a part respectively before and after treatment by a method of the invention.

Use was made of a nickel-based superalloy part coated by an yttria-stabilized zirconia (YSZ) thermal barrier obtained by electron beam physical vapor deposition (ED-PVD). The thermal barrier was initially damaged by water jet. FIG. 4A shows the result obtained after damaging.

Figure 4B:
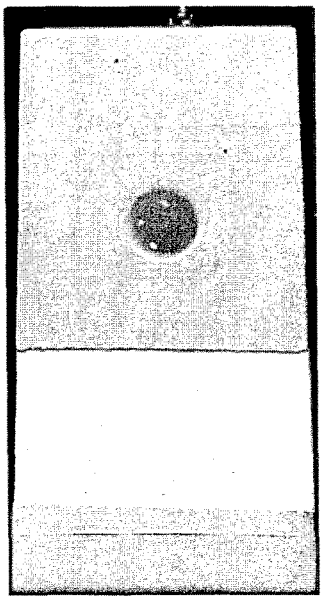

Electrophoresis deposition was performed using a suspension of YSZ powder in isopropanol (10 g/L) at a voltage of 100 V for six minutes. A photograph of the part after treatment by the method of the invention is shown in FIG. 4B.

It can be seen that a covering and uniform deposit of yttria-stabilized zirconia is obtained throughout the damaged zone.

The term "comprising/containing a/an" should be understood as "comprising/containing at least one"

The term "lying in the range . . . to . . . " should be understood as including the limits of the range.

The invention claimed is:

1. A method of localized repair to a damaged thermal barrier, the method comprising:

a) subjecting a part coated by a damaged thermal barrier to electrophoresis treatment, the part being made of an electrically conductive material, the damaged thermal barrier comprising a ceramic material and having a columnar structure, the damaged thermal barrier presenting at least one damaged zone that is to be repaired, the part being present in an electrolyte comprising a suspension of particles in a liquid medium, the particles in a non-agglomerated state having a mean size lying in the range from 20 nm to 1 μm, a ceramic coating being deposited by electrophoresis in the damaged zone in order to obtain a repaired thermal barrier for use at temperatures higher than or equal to 1000° C., the particles being made of a material different from the ceramic material present in the damaged thermal barrier, wherein prior to step a), the method includes a step of forming the particles by performing a sol-gel method, said sol-gel method comprising a supercritical drying of a liquid precursor to form the particles.

2. A method according to claim 1, wherein before the beginning of step a), the particles are present in the liquid medium at a concentration greater than or equal to 0.1 g/L.

3. A method according to claim 1, wherein the duration of step a) is greater than or equal to 1 minute.

4. A method according to claim 1, wherein a voltage greater than or equal to 1 V is imposed during all or part of step a) between the part and a counter electrode.

5. A method according to claim 1, wherein a thickness e of the deposited ceramic coating is greater than or equal to 30 μm.

6. A method according to claim 1, wherein the part is coated by an attachment layer enabling the thermal barrier to attach to the part, and wherein the ceramic coating is deposited on the attachment layer.

7. A method according to claim 1, wherein prior to step a), the damaged zone is subjected to a stripping step.

8. A method according to claim 1, wherein after step a), the method includes a step b) of consolidation by subjecting the deposited ceramic coating to heat treatment.

9. A method according to claim 1, wherein the part constitutes a turbine engine blade.

10. A method of localized repair to a damaged thermal barrier, the method comprising:

a) subjecting a part coated by a damaged thermal barrier to electrophoresis treatment, the part being made of an electrically conductive material, the damaged thermal barrier comprising a ceramic material and having a columnar structure, the damaged thermal barrier presenting at least one damaged zone that is to be repaired, the part being present in an electrolyte comprising a suspension of particles in a liquid medium, the particles in a non-agglomerated state having a mean size lying in the range from 20 nm to 1 μm, a ceramic coating being deposited by electrophoresis in the damaged zone in order to obtain a repaired thermal barrier for use at temperatures higher than or equal to 1000° C., the particles being made of a material different from the ceramic material present in the damaged thermal barrier, wherein a generator imposes a potential difference between the part and a counter electrode during the electrophoresis treatment, the generator generating a pulsed current during the electrophoresis treatment.

11. A method according to claim 10, wherein before the beginning of step a), the particles are present in the liquid medium at a concentration greater than or equal to 0.1 g/L.

12. A method according to claim 10, wherein the duration of step a) is greater than or equal to 1 minute.

13. A method according to claim 10, wherein a voltage greater than or equal to 1 V is imposed during all or part of step a) between the part and a counter electrode.

14. A method according to claim 10, wherein a thickness e of the deposited ceramic coating is greater than or equal to 30 μm.

15. A method according to claim 10, wherein the part is coated by an attachment layer enabling the thermal barrier to attach to the part, and wherein the ceramic coating is deposited on the attachment layer.

16. A method according to claim 10, wherein prior to step a), the damaged zone is subjected to a stripping step.

17. A method according to claim 10, wherein after step a), the method includes a step b) of consolidation by subjecting the deposited ceramic coating to heat treatment.

18. A method according to claim 10, wherein the part constitutes a turbine engine blade.

19. A method according to claim 10, wherein the counter electrode is made of platinum.

20. A method of claim 10, wherein the ceramic coating being deposited by electrophoresis in the damaged zone covers an entire surface of the damaged zone.

* * * * *